US007784188B1

(12) United States Patent
Yackshaw

(10) Patent No.: US 7,784,188 B1
(45) Date of Patent: Aug. 31, 2010

(54) SINGLE HAND EATING APPARATUS

(76) Inventor: John S. Yackshaw, 180 S. Washington St., Apt. 219, Wilkes Barre, PA (US) 18701-2936

( * ) Notice: Subject to any disclaimer, the term of this patent is extended or adjusted under 35 U.S.C. 154(b) by 0 days.

(21) Appl. No.: 12/546,504

(22) Filed: Aug. 24, 2009

(51) Int. Cl.
*A47J 43/28* (2006.01)

(52) U.S. Cl. ..... 30/148; 294/99.2

(58) Field of Classification Search ..... 30/147, 30/148; 294/99.2; D7/686
See application file for complete search history.

(56) References Cited

U.S. PATENT DOCUMENTS

| | | | | | |
|---|---|---|---|---|---|
| 57,918 | A | * | 9/1866 | Shaughnessy et al. | 30/148 |
| 546,376 | A | * | 9/1895 | Jennings | 30/148 |
| 1,341,153 | A | | 5/1920 | Parker et al. | |
| 1,585,533 | A | * | 5/1926 | Coursen et al. | 30/148 |
| D149,920 | S | * | 6/1948 | Warner | D7/686 |
| D166,100 | S | | 3/1951 | Roop | |
| 3,771,224 | A | * | 11/1973 | Bono, Jr | 30/148 |
| 3,977,715 | A | * | 8/1976 | Casci | 294/1.4 |
| 4,667,407 | A | * | 5/1987 | Grisé | 30/148 |
| 4,922,611 | A | | 5/1990 | Levy | |
| 4,995,154 | A | | 2/1991 | Bamber | |
| 5,054,835 | A | * | 10/1991 | Loechel et al. | 294/99.2 |
| 5,147,369 | A | * | 9/1992 | Wagner | 606/107 |
| 6,089,631 | A | * | 7/2000 | Thurlow et al. | 294/16 |
| 7,316,434 | B1 | * | 1/2008 | Kerr et al. | 294/16 |
| 7,458,163 | B2 | * | 12/2008 | Teich et al. | 30/425 |
| 2008/0054661 | A1 | * | 3/2008 | Schneider | 294/99.2 |

* cited by examiner

*Primary Examiner*—Hwei-Siu C Payer
(74) *Attorney, Agent, or Firm*—Crossley Patent Law; Mark A. Crossley

(57) ABSTRACT

The single hand eating apparatus provides a utensil that can be fully utilized with a single hand. The apparatus provides both knife and fork permanently and pivotally connected, the knife and fork providing combined and separate functionality. The apparatus provides an automatic return to open position without user effort. The apparatus provides optimum ergonomic design for ease of use, with important experimental derived dimensions.

9 Claims, 5 Drawing Sheets

SINGLE HAND EATING APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various combined eating utensils have been presented throughout the years. Most presented are combined but to be taken apart for use. Few if any exist that can therefore accommodate a person attempting to eat with a single hand. For that reason the present apparatus provides an eating utensil that can be grasped and used with only one hand, and offers the advantage of a knife and a fork that can function both alone and together.

FIELD OF THE INVENTION

The single hand eating apparatus relates to eating utensils and more especially to an eating utensil that can be fully utilized with a single hand.

SUMMARY OF THE INVENTION

The general purpose of the single hand eating apparatus, described subsequently in greater detail, is to provide a single hand eating apparatus which has many novel features that result in an improved single hand eating apparatus which is not anticipated, rendered obvious, suggested, or even implied by prior art, either alone or in combination thereof.

To attain this, the single hand eating apparatus provides a utensil that can be fully utilized with a single hand. The single hand eating apparatus provides both knife and fork permanently and pivotally connected. The apparatus provides an automatic return to open position without user effort. While the various curves of each of the knife and fork are present in the ideal embodiment, more basic embodiments may provide fewer curve features. The apparatus provides optimum ergonomic design for ease of use. While the dimensions are importantly experimentally derived, other various dimensioned apparatus are provided to suit various sizes and desires of the users. Very importantly, the knife and fork can be used in one hand both separately and in combined use.

Thus has been broadly outlined the more important features of the improved single hand eating apparatus so that the detailed description thereof that follows may be better understood and in order that the present contribution to the art may be better appreciated.

An object of the single hand eating apparatus is to provide a utensil that can be fully utilized with a single hand.

Another object of the single hand eating apparatus is to provide both knife and fork, and combined knife and fork functionality.

A further object of the single hand eating apparatus is to provide an automatic return to open position without user effort.

An added object of the single hand eating apparatus is to provide optimum ergonomic design for ease of use.

These together with additional objects, features and advantages of the improved single hand eating apparatus will be readily apparent to those of ordinary skill in the art upon reading the following detailed description of presently preferred, but nonetheless illustrative, embodiments of the improved single hand eating apparatus when taken in conjunction with the accompanying drawings.

In this respect, before explaining the current embodiments of the improved single hand eating apparatus in detail, it is to be understood that the single hand eating apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved single hand eating apparatus. It is therefore important that the claims be regarded as including such equivalent constructions insofar as they do not depart from the spirit and scope of the single hand eating apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the single hand eating apparatus generally designated by the reference number 10 will be described.

Figure 1:
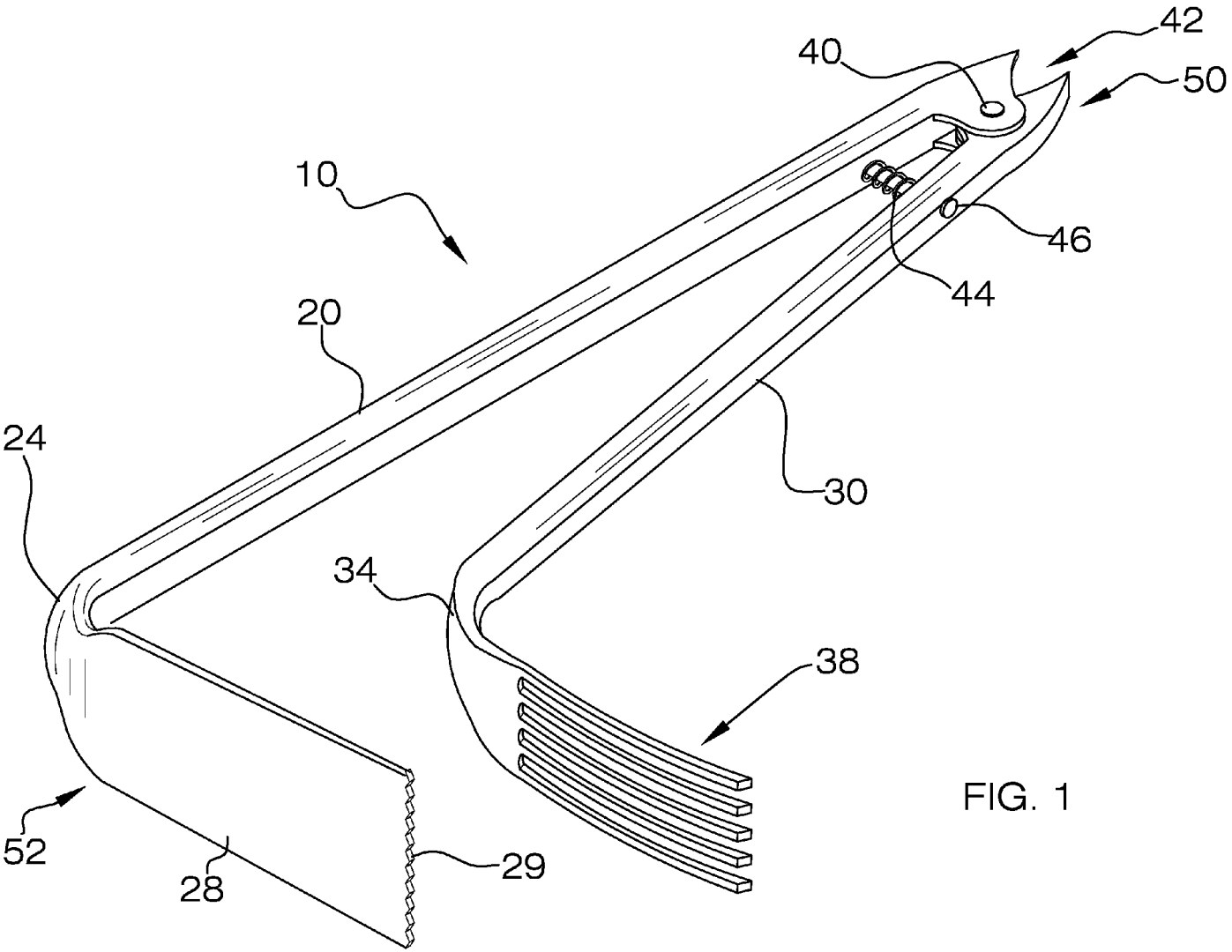
FIG. 1 is a perspective view.
Figure 2:
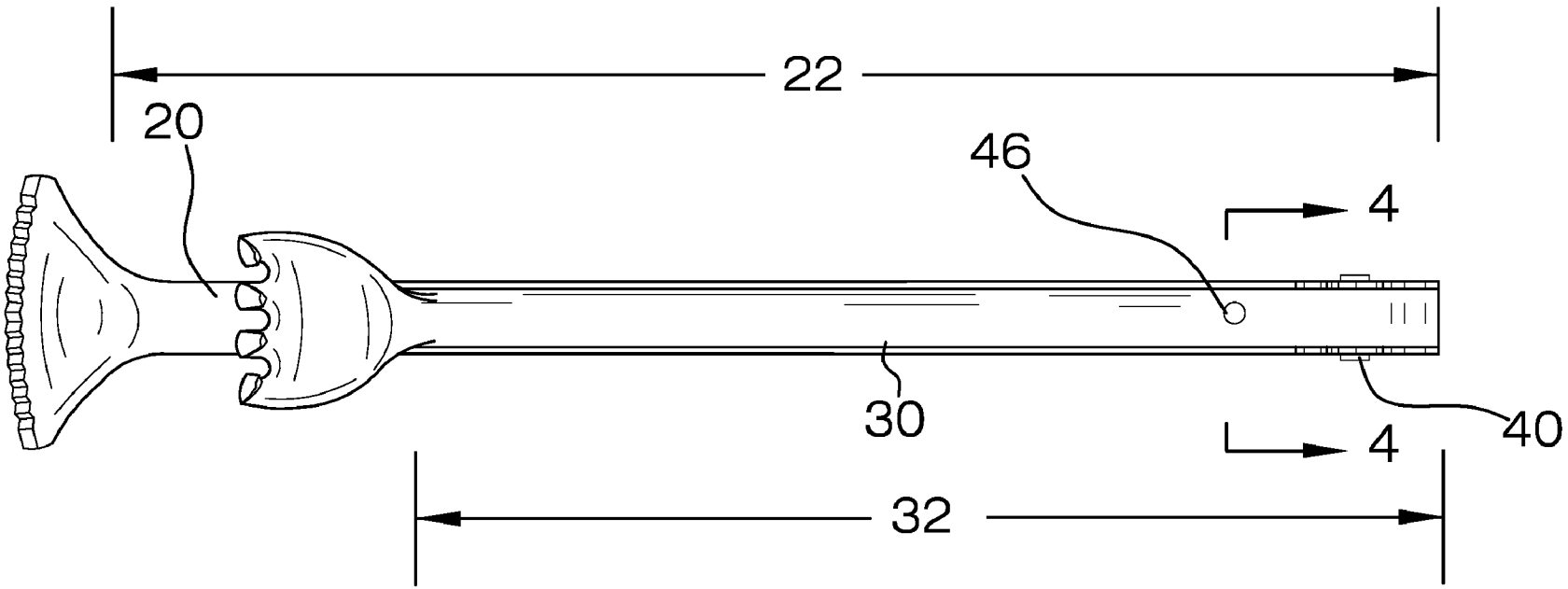
FIG. 2 is a bottom plan view.
Figure 3:
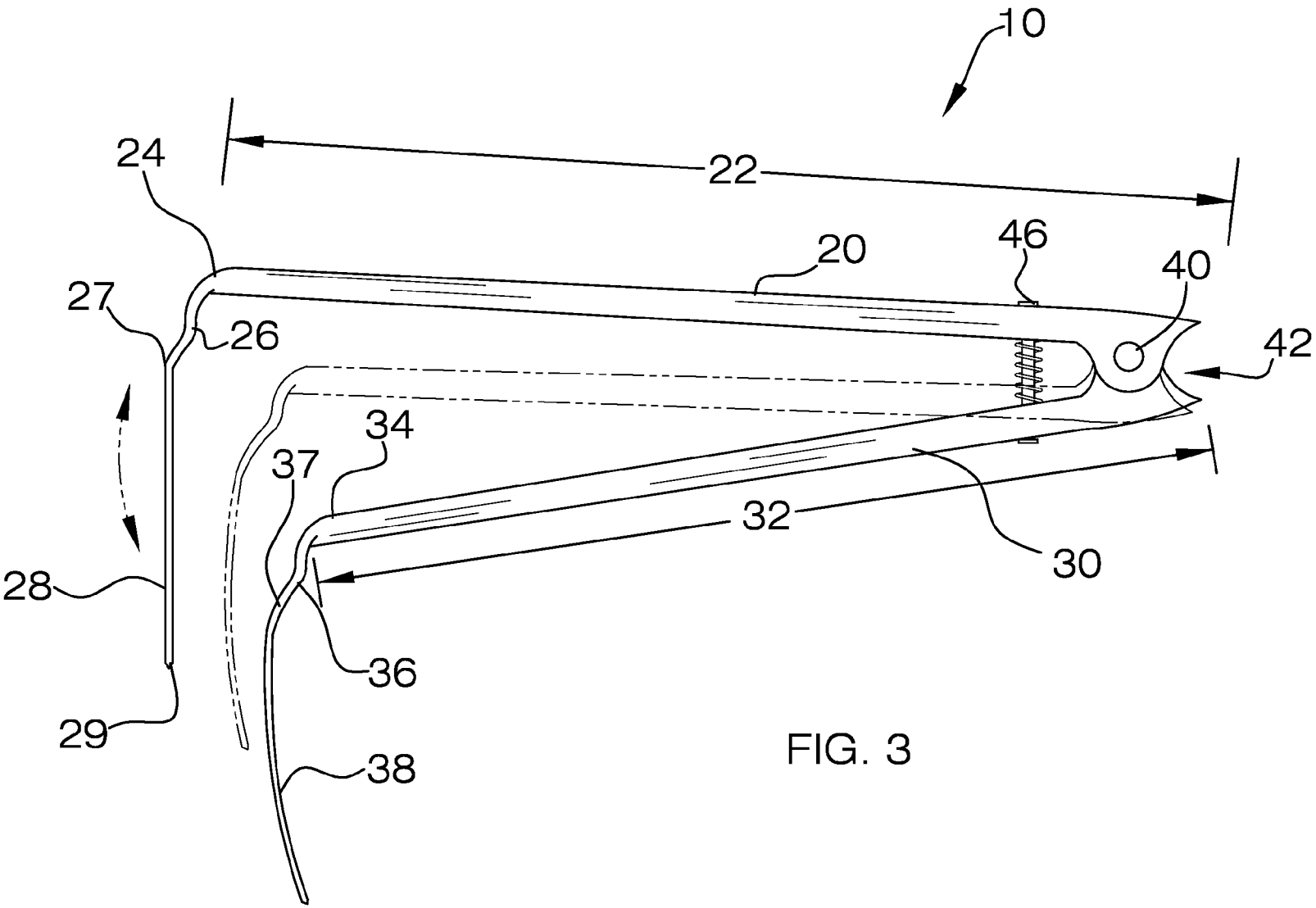
FIG. 3 is a lateral elevation view.

Referring to FIGS. 1, 2, and 3, the apparatus 10 has a proximal end 50 spaced apart from a distal end 52. The first arm 20 has a first arm length 22 of about 10 inches. The first arm bend 24 is disposed at the distal end 52 of the first arm 20. The first arm bend 24 is about 90 degrees. The knife outward curve 26 is extended from the first arm bend 24. The knife reverse curve 27 is extended from the knife outward curve 26. The flattened knife 28 is extended from the knife reverse curve 27. The cutting edge 29 terminates the knife 28 about 2 inches from the first arm 20. The second arm 30 is pivotally attached to the first arm 20 by the pivot 40 near the proximal end 50. The second arm 30 has a second arm length 32 of slightly less than the first arm length 22.

The second arm bend 34 is disposed at the distal end 52 of the second arm 30. The fork outward curve 36 is extended from the second arm bend 34. The fork reverse curve 37 is extended from the fork outward curve 36. The mirror image cutout 42 is in the proximal end 50 of each arm.

Figure 4:
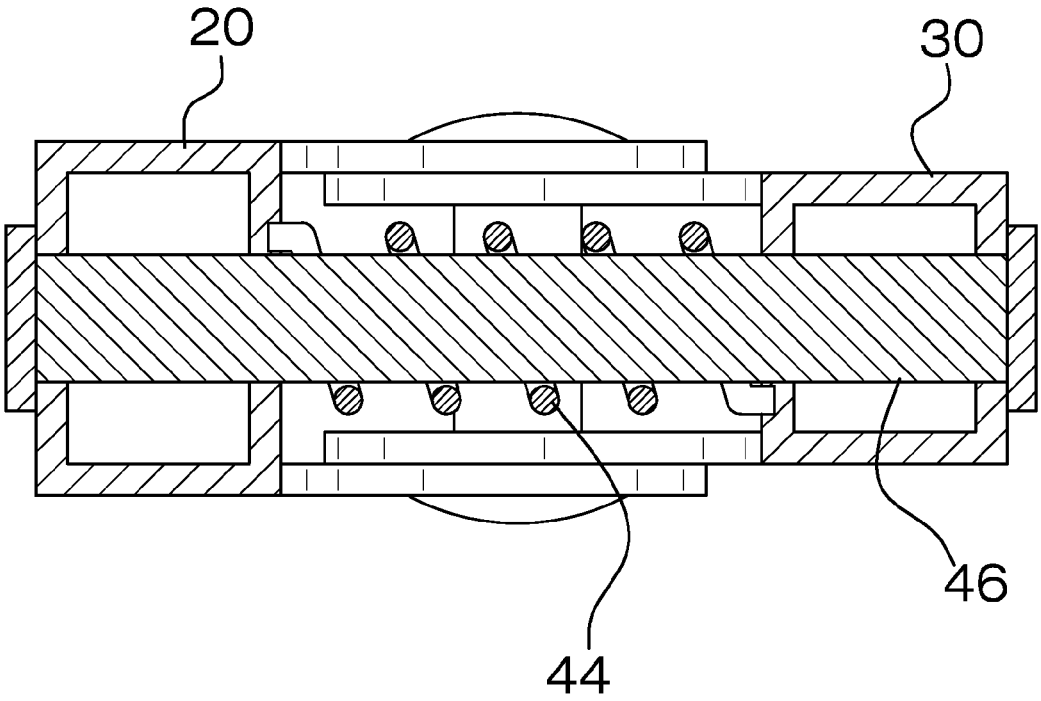
FIG. 4 is a cross sectional view of FIG. 2, taken along the line 4-4.

Continuing to refer to FIG. 1 and referring also to FIG. 4, the spring rod 46 connects the first arm 20 to the second arm 30. The spring rod 46 is disposed distally from the pivot 40. The expansion spring 44 is disposed around the spring rod 46 between the first arm 20 and the second arm 30. The expansion spring 44 ensures that the first arm 20 is separated from the second arm 30 without effort to overcome the spring 44.

Figure 5:
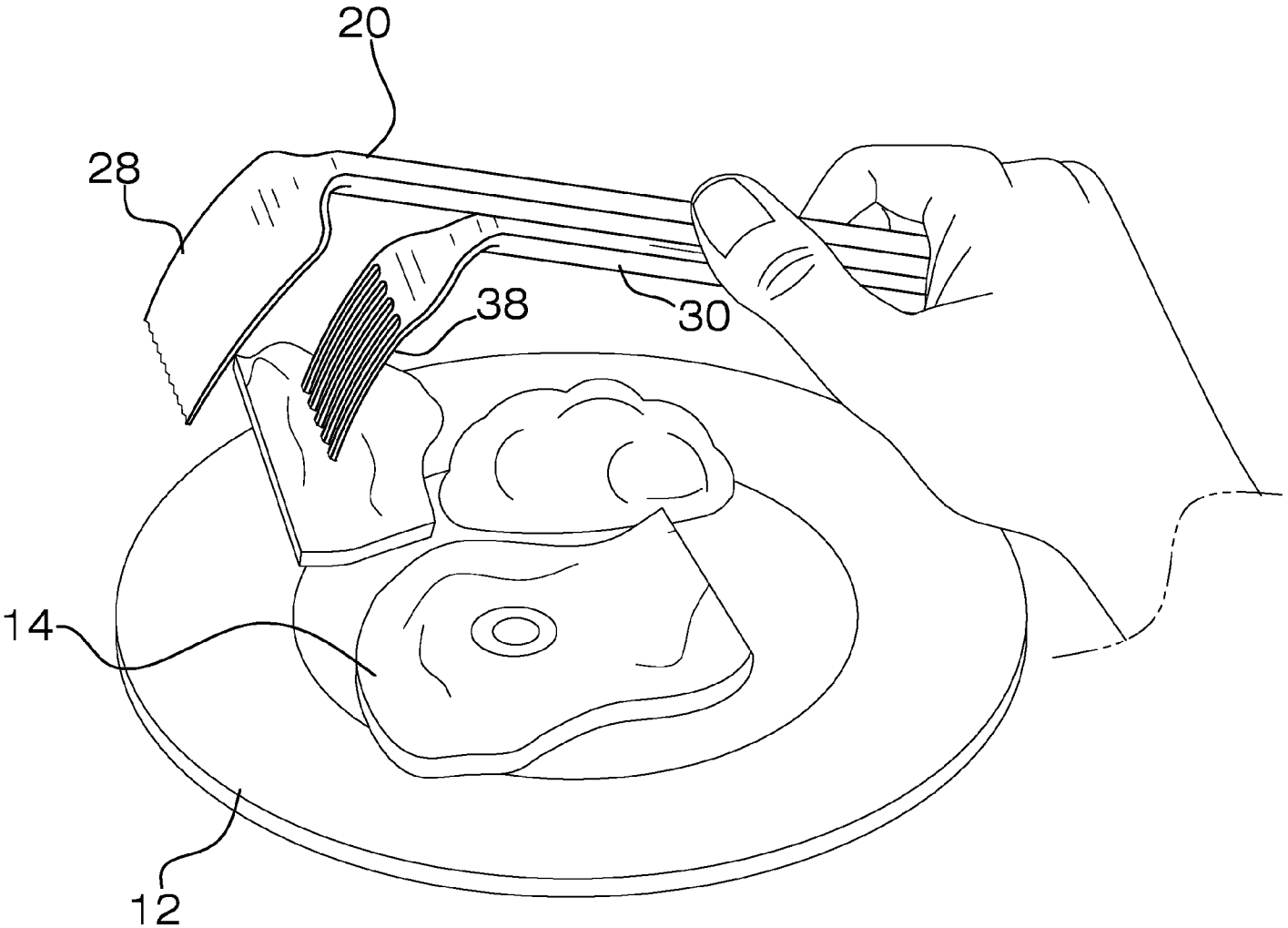
FIG. 5 is a perspective view of the apparatus in use.

Refer to FIG. 2 and also to FIG. 5 to evidence the slight difference between the first arm length 22 and the second arm length 32. In use, this important feature provides that the fork 38 can hold the food 14 against the plate 12 and the knife 28 be used to cut the food 14 at a desired width. The fork 38 can then retrieve the food 14.

With respect to the above description then, it is to be realized that the optimum dimensional relationships for the parts of the single hand eating apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the single hand eating apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the single hand eating apparatus may be used.

Therefore, the foregoing is considered as illustrative only of the principles of the single hand eating apparatus. Further, since numerous modifications and changes will readily occur to those skilled in the art, it is not desired to limit the single hand eating apparatus to the exact construction and operation shown and described, and accordingly, all suitable modifications and equivalents may be resorted to, falling within the scope of the single hand eating apparatus.

What is claimed is:

1. A single hand eating apparatus, comprising, in combination:

a proximal end spaced apart from a distal end;

a first arm, the first arm having a first arm length;

a first arm bend of about 90 degrees disposed at the first arm near the distal end;

a flattened knife extended from the first arm bend;

a cutting edge terminating the knife;

a second arm pivotally attached to the first arm by a pivot near the proximal end, the second arm having a second arm length slightly less than the first arm length;

a second arm bend of about 90 degrees disposed at the second arm near the distal end;

a fork extended from the second arm bend;

a mirror image cutout in the proximal end of each said arm;

a spring rod connecting the first arm to the second arm, the spring rod disposed distally from the pivot;

an expansion spring disposed around the spring rod between the first arm and the second arm.

2. The apparatus according to claim 1 wherein the cutting edge is a serrated cutting edge.

3. The apparatus according to claim 1 wherein the cutting edge is a smooth cutting edge.

4. The apparatus according to claim 1 wherein the cutting edge is further disposed about 2 inches from the first arm;

the fork terminates less than 2 inches from the second arm.

5. The apparatus according to claim 2 wherein the serrated cutting edge is further disposed about 2 inches from the first arm;

the fork terminates less than 2 inches from the second arm.

6. The apparatus according to claim 3 wherein the smooth cutting edge is further disposed about 2 inches from the first arm;

the fork terminates less than 2 inches from the second arm.

7. A single hand eating apparatus, comprising, in combination:

a proximal end spaced apart from a distal end;

a first arm having a length of about 10 inches;

a first arm bend of about 90 degrees disposed at the first arm near the distal end;

a knife outward curve extended from the first arm bend;

a knife reverse curve extended from the knife outward curve;

a flattened knife extended from the knife reverse curve;

a cutting edge terminating the knife, the cutting edge about 2 inches from the first arm;

a second arm pivotally attached to the first arm by a pivot near the proximal end, the second arm having a second arm length slightly less than the length of the first arm;

a second arm bend of about 90 degrees disposed at the second arm near the distal end;

a fork extended from the second arm bend;

a fork outward curve extended from the second arm bend;

a fork reverse curve extended from the fork outward curve, the fork terminating less than two inches from the second arm;

a mirror image cutout in the proximal end of each arm;

a spring rod connecting the first arm to the second arm, the spring rod disposed distally from the pivot;

an expansion spring disposed around the spring rod between the first arm and the second arm.

8. The apparatus according to claim 7 wherein the cutting edge further comprises a serrated cutting edge.

9. The apparatus according to claim 7 wherein the cutting edge further comprises a smooth cutting edge.

* * * * *